US006707031B1

(12) United States Patent
Weinberger et al.

(10) Patent No.: US 6,707,031 B1
(45) Date of Patent: Mar. 16, 2004

(54) LASER OPTICAL BENCH FOR LASER DESORPTION ION SOURCES AND METHOD OF USE THEREOF

(75) Inventors: Scot R. Weinberger, Montara, CA (US); Raymond G. Bryan, Reno, NV (US)

(73) Assignee: Ciphergen Biosystems, Inc., Fremont, CA (US)

( * ) Notice: Subject to any disclaimer, the term of this patent is extended or adjusted under 35 U.S.C. 154(b) by 0 days.

(21) Appl. No.: 09/568,745

(22) Filed: May 11, 2000

Related U.S. Application Data

(60) Provisional application No. 60/134,071, filed on May 13, 1999.

(51) Int. Cl.[7] ..... H01J 49/00
(52) U.S. Cl. ..... 250/281
(58) Field of Search ..... 250/281–300, 250/440.11, 442.11, 423 R, 424, 435, 425, 423 P; 359/888

(56) References Cited

U.S. PATENT DOCUMENTS

| | | | | |
|---|---|---|---|---|
| 4,112,461 A | | 9/1978 | Owens | |
| 5,146,463 A | * | 9/1992 | Rando | 235/462.21 |
| 5,252,831 A | * | 10/1993 | Weiss | 250/370.11 |
| 5,331,466 A | * | 7/1994 | Van Saarloos | 359/710 |
| 5,382,793 A | * | 1/1995 | Weinberger et al. | 250/281 |
| 5,461,235 A | * | 10/1995 | Cottrell et al. | 250/282 |

FOREIGN PATENT DOCUMENTS

| | | |
|---|---|---|
| EP | 0 103 426 A2 | 3/1984 |
| EP | 0 118 919 A2 | 9/1984 |
| EP | 0 378 283 A2 | 7/1990 |

OTHER PUBLICATIONS

Dreisewerd, et al. International Journal of Mass Spectrometry and Ion Processes vol. 1(1995) p. 128, "Influence of laser intensity and spot size on desorption of molecules and ions in matrix–assist laser desorption/ionization with uniform beam profile".*

Dreisewerd, Klaus et al. *International Journal of Mass Spectrometry and Ion Processes* vol. 141 (1995) pp. 127–148, *Influence of the laser intensity and spot size on the desorption of molecules and ions in matrix–assisted laser desorption/ionization with a uniform beam profile.*

Sze, Eric T.P. et al. *American Society For Mass Spectrometry* (1998) vol. 9, pp. 166–174 "*Formulation Of Matrix Solutions For Use In Matrix–Assisted Laser Desorption/Ionization Of Biomolecules*".

* cited by examiner

*Primary Examiner*—John R. Lee
*Assistant Examiner*—Christopher M. Kalivoda
(74) *Attorney, Agent, or Firm*—Townsend and Townsend and Crew LLP

(57) ABSTRACT

A laser optical bench for use with a laser desorption/ionization mass spectrometer. The laser optical bench includes a laser for producing light, a focusing structure that receives light from the laser and focuses predominantly in a single plane, an attenuator that receives light from the focusing structure, beam steering structure for directing light from the attenuator from the target; and a final focusing element for focusing light from the beam steering structure on the target. Further focusing elements may be included for further focusing and dispersing the light beam in different planes. Additionally, photodetectors or photodiodes may be included for energy measurement and sensing a lasing event.

57 Claims, 3 Drawing Sheets

-- PRIOR ART --

LASER OPTICAL BENCH FOR LASER DESORPTION ION SOURCES AND METHOD OF USE THEREOF

This application claims priority from U.S. Provisional Patent Application Ser. No. 60/134,071, filed May 13, 1999, the disclosure of which is incorporated herein by reference in its entirety.

BACKGROUND OF THE INVENTION

1. Field of the Invention

The present invention relates to a laser desorption ion source, and more particularly, to a laser optical bench for use with a laser desorption ion source that preferentially shapes a beam from a light source by predominantly focusing the beam in a single plane.

2. Description of the Prior Art

A laser desorption ion source is a device that utilizes the energy inherent in a focused laser beam to promote the desorption of neutrals and/or ions from solid or liquid state matter. In the case of solid matter, materials or samples of interest are presented as solid state crystals or thin films upon a sample support typically referred to as a probe. For liquid matter, the fluids are introduced as droplets or a fine spray and may be desorbed in stream or upon a physical support.

The energy transfer process may proceed through direct thermal or electronic excitation of the material or through indirect thermal excitation. If the material directly absorbs energy from the laser source and heats up via direct thermal or secondary thermal changes in response to electronic excitation, the process is known as laser-induced thermal desorption (LITD). If the material of interest receives thermal energy from neighboring compounds while being a member of a co-crystal or thin film matrix, the process is known as matrix-assisted laser desorption (MALD). If the material or sample of interest has been physically modified, extracted or amplified by the probe surface, or if the probe surface contains integral energy absorbing molecules capable of indirect energy transfer to the sample of interest, the process is known as surfaced enhanced laser desorption (SELD).

Should preferential ionization be created for the above described desorption motifs, then such processes are respectively referred to as laser desorption/ ionization (LDI), matrix-assisted laser desorption/ionization (MALDI), and surface enhanced laser desorption/ionization (SELDI).

Regardless of which energy transfer process is used, a laser desorption ion source primarily consists of a collection of components generally referred to as a laser optical bench. Such a laser optical bench is schematically represented in FIG. 1.

Generally, a laser optical bench 10 includes a light source or photon source 11, which is generally a continuous beam or pulsed laser, a beam splitter 12, photodiode or other photodetector 13, attenuator 14, lens 15, mirror 16 and target 17, which is generally a probe including a sample of material of interest.

If a continuous beam laser is employed as light source 11, desorption/ionization occurs with a constant duty cycle. If desired, high speed gating of the beam is typically achieved by using a shutter, which blocks the beam or a movable mirror that directs the beam into a beam dump (not shown). If a pulsed laser is employed as light source 11, the duty cycle is dependent upon the pulse width and repetition rate.

High speed gating of the beam is achieved by controlling the pulsing process.

In some situations, the laser optical bench may include a photodetector or photodiode 13 to measure the energy of the laser source or to detect the lasing event in the case of pulsed laser applications. Typically, optical beam splitter 12 is used to divide off a small fraction of the incident beam and direct it toward the appropriate photodetector. If the photodetector is used to measure delivered energy, it is usually of the thermal, photo-emissive, or semiconductor detector varieties. If the photodetector functions to detect the lasing event of a pulsed laser train, the photodetector is preferentially a small surface area semiconductor photodiode, which is capable of delivering very fast response times.

The propagated laser beam needs to be processed for the purposes of laser desorption. Such processing often involves control of laser energy, laser fluence (laser energy/unit area), and/or laser irradiance (radiant power/unit area). To achieve the latter, a combination of lenses and attenuation devices are often used. Typical laser energy attenuation devices include a mechanical iris, a neutral density filter or a fresnel reflection/refraction device. If a neutral density filter has a gradient of optical densities allowing for continuous adjustment of transmitted laser energy, it is referred to as a gradient neutral density filter (GNDF).

The ultimate size of the focused laser spot on the target is controlled through prudent selection of mirrors and lenses. Typically, a design that optimizes optical throughput while providing the desired fluence or irradiance dynamic range is employed. Additionally, the combination of attenuating and focusing elements should optimally create an image whose spatial distribution creates a desorption locus that promotes maximum sampling area while maintaining maximum ion extraction efficiency.

Increasing sampling area has three major advantages, specifically decreased analysis time, improved sample-to-sample reproducibility, and increased analytical sensitivity. The advantage of decreased analysis time is readily apparent and generally desirable. If one addresses a greater amount of sample area with each laser spot, a given sample region may be completely interrogated in less time than that required by approaches that employ smaller laser spots.

Typical sample preparation techniques for the previously noted laser desorption scheme inherently create solid-state or liquid samples with appreciable amounts of heterogeneity and microenvironmental differences. These differences are sources of qualitative and quantitative in reproducibility when assaying a plurality of identical samples. Although some approaches, such as SELDI, function to minimize these effects, statistically significant perturbations may still be observed. The employment of large laser probed regions improves reproducibility by increasing the area of sample investigated for each laser desorption event, statistically minimizing the effect of microheterogeneity.

The means by which target probed areas are enlarged is important with respect to sample laser irradiance. Generally speaking, sample desorption and ionization for the previously identified schemes occur at some threshold irradiance level. Furthermore, it is often desirable to have the ability to operate at levels significantly higher than threshold. Consequently, a given increase in laser spot area would require a concomitant increase in laser radiant power. Such laser radiant power increases may result in the need to employ more powerful and expensive laser sources. Accordingly, so, a means which increases the target sampling area that does not necessitate significant increases in laser radiant power is desired.

Increased analytical sensitivity is achieved by virtue of the fact that more sample is desorbed and ionized for each desorption event, assuming that the additional ionized material within the desorption cloud may be efficiently extracted. The desorption cloud can be considered to be a collection of ions, neutrals, and electrons capable of shielding externally applied electrical fields. It is generally recognized that ion extraction occurs within a given axial length of the desorption cloud known as the plasma skin depth. The plasma skin depth is that portion of a cloud's outer perimeter for which externally applied electric fields penetrate and do work upon charged particles. It is typically determined by the fundamental energetics of the desorption process and for a given set of conditions, is considered to be relatively dependent upon the cloud's charged particle density.

For the previously noted techniques, desorption cloud charge particle density has been determined to be dependent upon applied laser irradiance. Low irradiance levels produce clouds of nominal charged particle density. Under these conditions, the plasma skin depth can extend appreciably into the center of the desorption cloud and a vast majority of the desorbed ions can be efficiently extracted. In contrast, the application of high irradiance levels create clouds of extreme charged particle density, producing a plasma skin depth that is a fraction of the total cloud size, thus providing for sub-optimal levels of ion extraction. The distinction of low versus high laser irradiance levels is dependent upon the ionization technique. For the applications of SELDI and MALDI, high laser irradiance can be considered to be that which exceeds 10 $mW/cm^2$.

From the previous explanation, it becomes clear that optimum ion extraction efficiency will be achieved under conditions for which a maximum population of desorbed ions reside within the plasma skin depth. In this manner, laser spot geometries that promote desorption clouds with maximized surface area to volume ratios are favored.

Further complicating this process is the requirement for creating homogeneous energy, fluence, or irradiance profiles across the laser spot. During the process of desorption and ionization, the initial energy conditions of these gaseous products have been shown to be somewhat dependent upon the initial amount of applied laser energy. If the laser image contains positional dependent energy gradients or hot regions, desorbed products from different regions may exhibit significantly different initial energies. This condition may be detrimental to mass analysis, especially if non-orthogonal time-of-flight mass spectrometric techniques are employed.

SUMMARY OF THE INVENTION

A laser optical bench, in accordance with the present invention, for use with a laser desorption/ionization mass spectrometer addresses the shortcomings of the prior art. Such a laser optical bench includes a laser for producing light, a beam expanding focusing structure that receives light from the laser and focuses it in predominantly a single plane, an attenuator that receives light from the beam expanding focusing structure, a beam steering structure for directing light from the attenuator to a target, and an omnidirectional focusing element for focusing light from the beam steering structure on the target.

The combined action of the aforementioned elements generally serves the purpose of minimizing laser spot energy heterogeneity while creating a target probe sampling spot geometry of enlarged surface area and a desorption cloud with maximized surface area to volume ratio.

In accordance with further preferred aspects of the present invention, the beam expanding focusing structure consists of a pair of cylindrical lenses, and the laser optical bench further includes a plano convex lens that focuses the light from the beam steering structure onto the target probe.

In accordance with another preferred aspect of the present invention, the first cylindrical lens of the beam expanding focusing structure preferentially focuses the laser beam in a single plane with respect to a gradient neutral density filter attenuator. The orientation of the focusing plane is aligned with the gradient direction of the neutral density filter so that a minimum energy gradient exists across the beam transmitted through the filter. Furthermore, because the incident beam is allowed to diverge in regions outside of the focusing plane, the laser spot area incident to the GNDF is sufficiently large so as to limit the incident irradiance to levels below that of the GNDF damage threshold. A second cylindrical lens is used to collect the transmitted beam and, in combination with the inherent beam divergence of the laser source, expand it to match the numerical aperture of the remaining optical elements.

In accordance with another preferred aspect of the present invention, the beam steering structure generally includes a mirror that reflects light to a dichroic filter. The dichroic filter allowing some light to pass therethrough while reflecting a majority of the light to the target probe. The light transmitted through the dichroic filter is then preferably passed to a piano convex lens that focuses the light onto a photodetector in order to measure the amount of applied laser energy.

Thus, the present invention provides a laser optical bench for use with a laser desorption/ionization mass spectrometer that allows for beam shaping, which is created by preferentially focusing the laser beam to a minimum dispersion in only one plane. By initially focusing the laser beam in a single plane, a decreased spatial laser energy gradient across the beam after it passes through the attenuator is realized. Furthermore, beam expansion is realized by the combined action of the second cylindrical lens and the inherent beam divergence of the laser source, thus utilizing the full numerical aperture of the system while selectively allowing expansion in only one dimension. Finally, ion desorption loci are created that are shaped in a manner that optimizes ion collection/extraction efficiency.

Other features and advantages of the present invention will be understood upon and reading and understanding the detailed description of the preferred exemplary embodiments, found hereinbelow, in conjunction with reference to the drawings in which like numerals represent like elements.

DETAILED DESCRIPTION OF THE PREFERRED EXEMPLARY EMBODIMENTS

Figure 1:
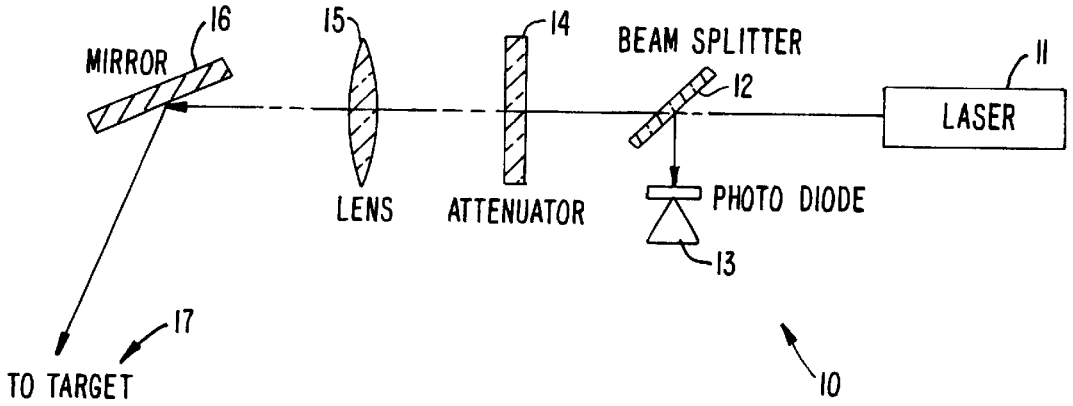
FIG. 1 is a schematic view of a prior art laser optical bench.
Figure 2:
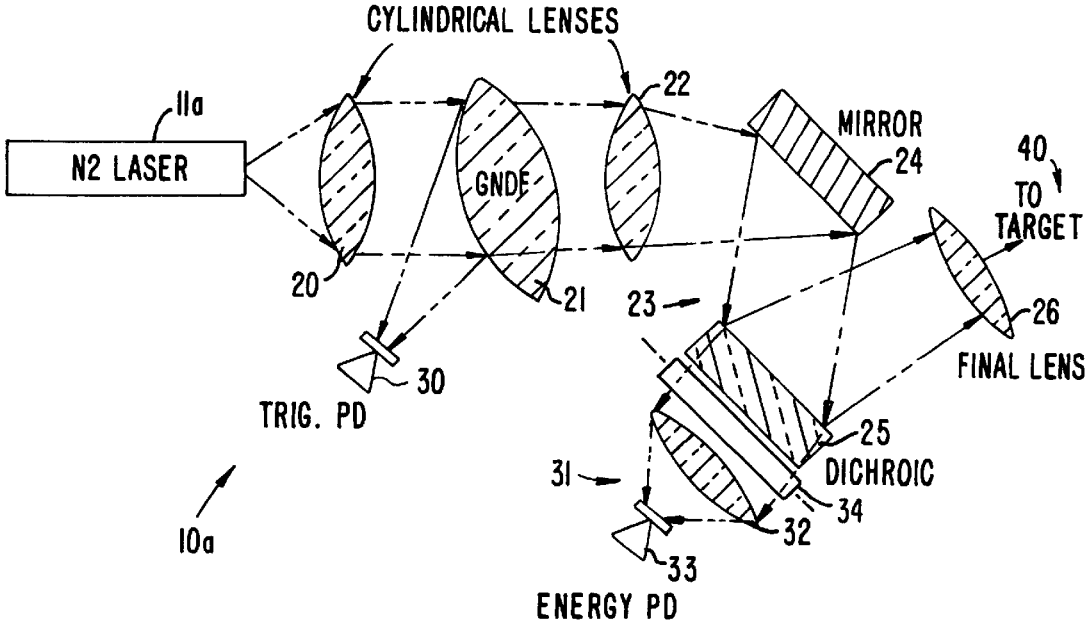
FIG. 2 is a schematic view of a laser optical bench in accordance with the present invention.

With reference to FIG. 2, a laser optical bench 10*a* in accordance with a preferred embodiment of the present invention is illustrated. The laser optical bench includes a light source or photon source 11*a*, preferably in the form of a laser. A first lens is provided for focusing light from the laser onto an attenuator 21. A second lens 22 is provided as a focusing element for focusing light from the attenuator to a beam steering apparatus. Preferably, the beam steering apparatus includes a mirror 24 and a filter 25. In preferred embodiments, the filter consists of a dichroic filter or a dichroic mirror. Finally, a final lens 26 is provided as a focusing element for focusing light on a target 40, which is generally a sample probe.

In preferred embodiments, a trigger photodetector or photodiode 30 is provided as a lasing event sensor. Trigger photodiode 30 receives light from attenuator 21 and thus, attenuator 21 also serves as a beam splitter in such an embodiment.

Additionally, in preferred embodiments, laser optical bench 10*a* includes an energy measuring apparatus 31 that preferably includes a lens 32 that is used as a focusing element for focusing light on an energy photodiode or photodetector 33, which measures the amount of applied laser energy. Energy measuring apparatus 31 receives light that is transmitted through filter 25.

In another preferred embodiment, energy measuring apparatus 31 contains a notch or bandwidth filter 34 so that only light within the wavelength range of source 11*a* is transmitted to the surface of photodetector 33.

Preferably, laser 11*a* is a pulsed nitrogen laser. Other lasers, either pulsed or continuous wave, may also be employed. Light emerging from the laser is focused by a first cylindrical lens predominantly in a single plane, preferably in a vertical plane or a horizontal plane.

Figure 3:
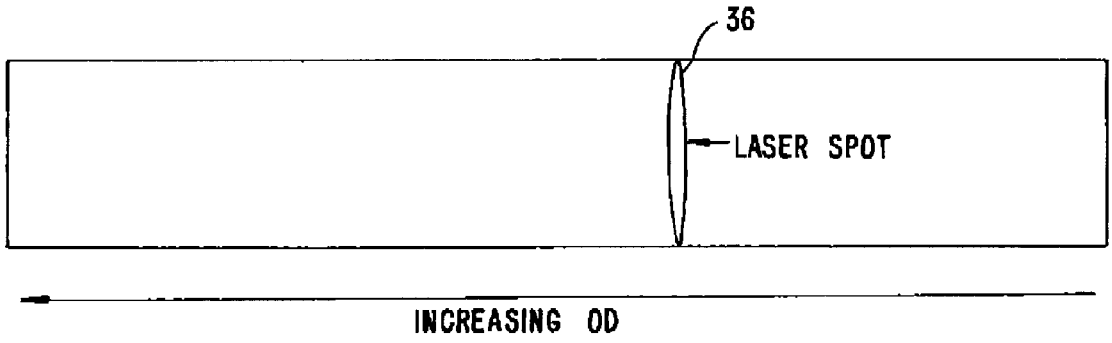
FIG. 3 schematically illustrates a rectangular gradient neutral density filter in which the optical density (OD) increases from right to left.

With reference to FIG. 3, a configuration of the laser optical bench 10*a* wherein light is focused in the vertical plane illustrates the lens 20 creating an image that is somewhat cigar-shaped. This cigar-shaped image 36 is impinged upon attenuator 21.

In a preferred embodiment, attenuator 21 is a gradient neutral density filter. In the embodiment illustrated in FIG. 2, the GNDF is shown to be circular. However, one skilled in the art will realize that other geometric arrangements such as polygonal, rectangular, or square may also be employed. Depending upon the nature of the optical density gradient of GNDF, cigar-shaped image 36 is created in a manner so that a minimal energy gradient exists across the beam as it is transmitted through the GNDF. Such a process is depicted in FIG. 3.

FIG. 3 illustrates a rectangular GNDF in which the optical density (OD) increases from right to left. Cigar-shaped laser spot 36 is vertically arranged such that a minimum OD gradient exists along its vertical and horizontal axes, thus minimizing any positional dependent energy difference within the transmitted light beam. Furthermore, because the spot is allowed to diverge in the vertical plane while being focused in the horizontal plane, the over all area of spot 36 is sufficiently large as to diminish the level of incident irradiance to be below that of the GNDF damage threshold.

In a preferred embodiment that includes trigger photodiode 30 as a lasing event sensor, a small portion of the beam incident to GNDF 21 (preferably approximately 4%) is selectively reflected toward trigger photodiode 30, which is preferable a high speed photodetector. Light transmitted through GNDF 21 passes through second lens 22, which is used to expand the transmitted light beam.

The expanded light beam then encounters beam steering apparatus 23. Beam steering mirror 24 is used to adjust for minor alterations and beam locations by reflecting the expanded light. Preferably, the expanded light is reflected toward a filter 25. The filter properties are selected so as to reflect the majority of the incident radiation toward the target, while preferably transmitting a small fraction of the incident beam (preferably less than 10%) toward energy measuring apparatus 31. A portion of the transmitted incident light beam that is transmitted through filter 25 may then be focused by lens 32 of energy measuring apparatus 31 through bandwidth filter 34 onto energy photodetector 33. This is used to measure the amount of applied laser energy. The output of energy photodetector 33 may be calibrated in such a manner so as to reflect the total amount of energy being delivered to sample probe 40.

Additionally, it is advantageous for filter 25 to transmit visible light from target or sample probe 40. In this manner, it may be used as a port through which direct sample or laser spot viewing may be possible.

Figure 4:
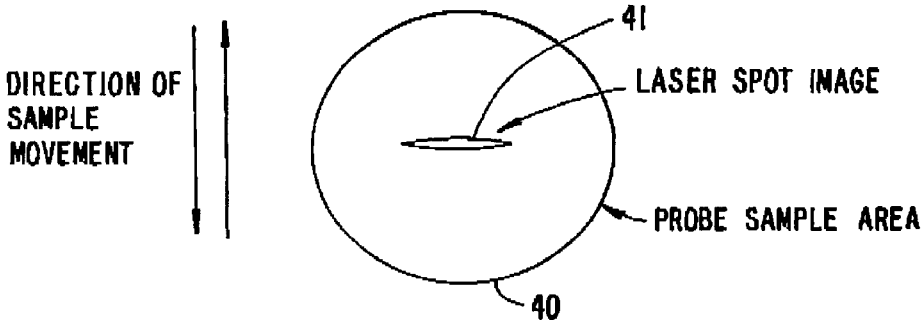
FIG. 4 illustrates an improved laser spot on a target probe sample area created by a laser optical bench in accordance with the present invention.

Thus, the combination of mirror 24 and filter 25 is used to create a beam steering apparatus that directs the beam in the appropriate optical plane necessary to optimally strike the target probe, thereby compensating for possible differences in initial beam position. Final lens 26 is provided as a focusing element to create the ultimate laser spot image 41 upon sample probe 40 by focusing the reflected light beam of filter 25. Such an improved laser spot is illustrated in FIG. 4.

Preferably, lens 20 and lens 22 are either cylindrical lenses or ellipsoidal mirrors. Final lens 26 is preferably a concave mirror, a plano convex lens, or a biconvex lens. In a preferred embodiment, lenses 20 and 22 are cylindrical lenses, while lenses 26 and 32 are plano convex lenses. In such a preferred embodiment, lens 20 preferably has a 0.75 inch diameter, a 25 mm thickness, and an effective focal length (EFL) of 6.70 mm. Lens 22 preferably has a 1 inch diameter, 4.36 mm thickness and a 75 mm EFL. Lenses 26 and 32 preferably have 20 mm diameters, 3 mm thicknesses and 70 mm EFLs. Lens sizes and focal lengths are chosen to operate ideally with a given light source. Lens materials are selected to be consistent with wavelength and irradiance/energy, requirements. The above dimensions for the lenses are chosen to ideally work with a nitrogen source laser (337 nm) possessing a given amount of beam divergence, and having pulse energies of 200 microjoules.

In a preferred embodiment, mirror 24 consists of UV enhanced aluminum and has dimensions of 25 $mm^2$ by 6 mm. Also, in a preferred embodiment, filter 25 is a dichroic filter optimized for 15 degrees of incidence, 90% reflection/8% transmission at 337 nm, 80% transmission at 450 nm, and a 1 inch diameter. Once again, the size and composition of the mirror and dichroic filter are selected according to the incident wavelength, incident irradiance and beam divergence.

The improved laser spot geometry that results from the laser optical bench in accordance with the present invention preferably creates an image that has been measured to be about 1 mm in width and less than 50 microns in height. Thus, preferably a width or length or major axis of the image is approximately 20 times greater than a height or length or minor axis of the image. However, the ratio may be between 5 to 1 and 20 to 1 but preferably is around 20 to 1.

Figure 5:
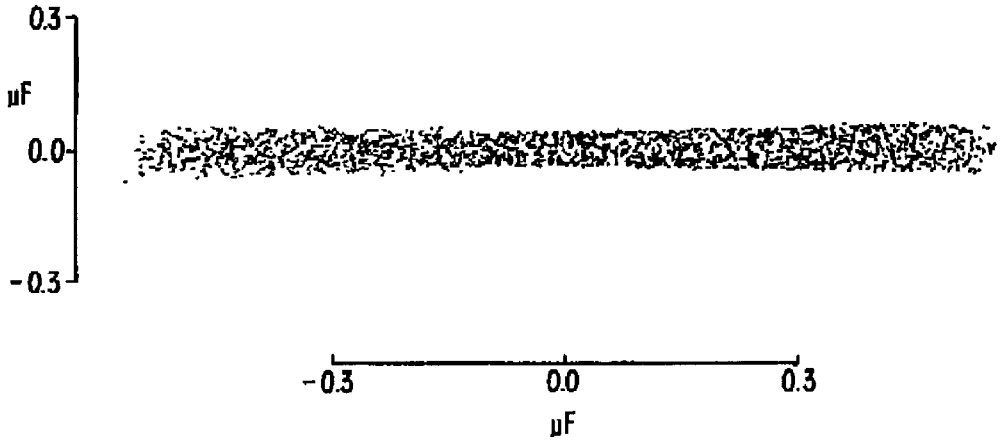
FIG. 5 is an image of the improved laser spot geometry as achieved with a laser optical bench in accordance with the present invention.

FIG. 5 depicts the measured laser spot image. This laser spot geometry results in covering a wide region of the sample probe while simultaneously producing a cigar-shaped desorption locus. Even though this laser spot is about 5–10 times wider than that of conventional approaches, adequate laser fluence for desorption and ionization is obtained by focusing only in one plane, thereby minimizing and conserving total irradiated area. In this manner, the need for greater input laser energy levels is avoided, thereby allowing the employment of small, low cost laser platforms.

Successive desorption loci are overlapped by progressively advancing the sample in a vertical direction while the laser spot location remains fixed. In this manner, additional regions of the sample presenting area may be interrogated. Because the desorption locus is preferably cigar-shaped, the resulting desorption plume is spread out so as to have a maximized surface area to volume ratio.

The laser optical bench in accordance with the present invention has thus demonstrated improved performance in the formation and collection of ions created by a laser desorption ion source in the applications of matrix assisted laser desorption/ionization (MALDI) and surface enhanced laser desorption/ionization (SELDI). The laser optical bench in accordance with the present invention employs a cylindrical lens beam expander for the purpose of minimizing laser spot energy heterogeneity while creating a sampling spot with large surface area and maximized desorption cloud surface to volume ratio.

Those skilled in the art will recognize that a laser optical bench in accordance with the present invention is suitable for use with a laser desorption/ionization mass spectrometer that consists of a magnetic sector, electrostatic analyzer, ion trap, quadrapole, other rf mass filter-like analyzer, time-of-flight, and ion cyclotron resonance device. Additionally, a laser optical bench in accordance with the present invention is suitable for use with a hybrid device of two of the above devices. Furthermore, a laser optical bench in accordance with the present invention, is suitable for use with a laser desorption/ionization ion mobility mass spectrometer.

Although the invention has been described with reference to specific exemplary embodiments, it will appreciated that it is intended to cover all modifications and equivalents within the scope of the appended claims.

What is claimed is:

1. A laser optical bench for use with a laser desorption/ionization mass spectrometer, the laser optical bench comprising:

a laser for producing light;

focusing and beam expanding means that receives light from the laser and focuses it predominantly in a single plane, wherein the plane is defined by a major axis and a minor axis;

a gradient neutral density filter (GNDF) having an optical density gradient, wherein the focusing and beam expanding means orients the light on the GNDF such that the major axis is aligned with the optical density gradient in a neutral density orientation;

beam steering means for directing light from the GNDF to a target; and a first focusing element for focusing light from the beam steering means on the target, thereby producing a target image;

wherein the ratio of the major axis to the minor axis of the target image is in a range of 5:1 and 20:1.

2. The laser optical bench of claim 1 wherein the beam steering means comprises a dichroic element.

3. The laser optical bench of claim 2 wherein the dichroic element is a dichroic filter.

4. The laser optical bench of claim 2 wherein the dichroic element is a dichroic mirror.

5. The laser optical bench of claim 2 wherein the beam steering means further includes a mirror located between the GNDF and the dichroic element.

6. The laser optical bench of claim 1 further comprising a focusing element between the GNDF and the beam steering means for expanding light from the GNDF attenuator.

7. The laser optical bench of claim 6 wherein the beam steering means further includes a mirror located between the focusing element and the dichroic element.

8. The laser optical bench of claim 1 further comprising a trigger photodiode that receives light from the GNDF.

9. The laser optical bench of claim 1 further comprising means for measuring an amount of applied laser energy in the light directed to the target.

10. The laser optical bench of claim 9 wherein the means for measuring an amount of applied laser energy in the light directed to the target comprises a second focusing element, a bandwidth filter, and a photodetector.

11. The laser optical bench of claim 1 wherein the focusing and beam expanding means comprises one of either a cylindrical lens or an ellipsoidal mirror.

12. The laser optical bench of claim 1 wherein the focusing element comprises one of either a concave mirror, a plano convex lens, or a biconvex lens.

13. The laser optical bench of claim 6 wherein the focusing element comprises one of either a cylindrical lens or an ellipsoidal mirror.

14. A laser optical bench for use with a laser desorption/ionization mass spectrometer, the laser optical bench comprising:

a laser for producing light;

a first focusing element that receives light from the laser and focuses it predominantly in a single plane, wherein the plane is defined by a major axis and a minor axis;

a gradient neutral density filter (GNDF) wherein the first focusing means orients the light on the GNDF such that the major axis is aligned with the optical density gradient in a neutral density orientation;

a second focusing element for collecting and expanding light from the gradient neutral density filter;

beam steering means for directing light from the second focusing element to a target, the beam steering means including a dichroic element; and a third focusing element for focusing light from the beam steering means on the target thereby producing a target image;

wherein the ratio of the major axis to the minor axis of the target image is in a range of 5:1 and 20:1.

15. The laser optical bench of claim 14 wherein the dichroic element is a dichroic filter.

16. The laser optical bench of claim 14 wherein the dichroic element is a dichroic mirror.

17. The laser optical bench of claim 14 wherein the beam steering means further includes a mirror located between the second lens and the dichroic element.

18. The laser optical bench of claim 14 further comprising a trigger photodiode that receives light from the gradient neutral density filter.

19. The laser optical bench of claim 14 further comprising means for measuring an amount of applied laser energy in the light directed to the target.

20. The laser optical bench of claim 19 wherein the means for measuring an amount of applied laser energy in the light directed to the target comprises a fourth focusing element and a photodetector.

21. The laser optical bench of claim 19 wherein the means for measuring an amount of applied laser energy in the light directed to the target comprises a bandwidth filter and a photodetector.

22. The laser optical bench of claim 14 wherein the first focusing element comprises one of either a cylindrical lens or an ellipsoidal mirror.

23. The laser optical bench of claim 14 wherein the third focusing element comprises one of either a concave mirror, a plano convex lens, or a biconvex lens.

24. The laser optical bench of claim 14 wherein the second focusing element comprises one of either a cylindrical lens or an ellipsoidal mirror.

25. The laser optical bench of claim 14 wherein the first focusing means element comprises a cylindrical lens, the second focusing element comprises a cylindrical lens, and the third focusing element comprises a plano convex lens.

26. The laser optical bench of claim 25 further comprising means for measuring an amount of applied laser energy in the light directed to the target, the means for measuring an amount of applied laser energy in the light comprising a plano convex lens, bandwidth filter, and a photodetector.

27. A laser desorption/ionization mass spectrometer comprising a laser optical bench, wherein the laser optical bench comprises:

a laser for producing light;

focusing and beam expanding means that receives light from the laser and focuses it predominantly in a single plane, wherein the plane is defined by a major axis and a minor axis;

a gradient neutral density filter (GNDF) having an optical density gradient, wherein the focusing and beam expanding means orients the light on the GNDF such that the major axis is aligned with the optical density gradient in a neutral density orientation;

beam steering means for directing light from the GNDF to a target; and a first focusing element for focusing light from the beam steering means on the target, thereby producing a target image;

wherein the ratio of the major axis to the minor axis of the target image is in a range of 5:1 and 20:1.

28. The laser desorption/ionization mass spectrometer of claim 27 wherein the beam steering means comprises a dichroic element.

29. The laser optical bench of claim 28 wherein the dichroic element is a dichroic filter.

30. The laser desorption/ionization mass spectrometer of claim 28 wherein the dichroic element is a dichroic mirror.

31. The laser desorption/ionization mass spectrometer of claim 28 wherein the beam steering means further includes a mirror located between the GNDF and the dichroic element.

32. The laser desorption/ionization mass spectrometer of claim 27 wherein the laser optical bench further comprises a second focusing element between the GNDF and the beam steering means for collecting and expanding the light from the GNDF.

33. The laser desorption/lionization mass spectrometer of claim 27 wherein the optical laser bench further comprises a trigger photodiode that receives light from the GNDF.

34. The laser desorption/ionization mass spectrometer of claim 27 wherein the laser optical bench further comprises means for measuring an amount of applied laser energy in the light directed to the target.

35. The laser desorption/ionization mass spectrometer of claim 34 wherein the means for measuring an amount of applied laser energy in the light directed to the target comprises a second focusing element and a photodiode.

36. The laser desorption/ionization mass spectrometer of claim 27 wherein the laser desorption/ionization mass spectrometer consists of one from a group consisting of a magnetic sector, electrostatic analyzer, ion trap, quadrapole, other rf mass filter-like analyzer, and time-of-flight, or a hybrid from the group.

37. The laser desorption/ionization mass spectrometer of claim 27 wherein the laser desorption/ionization mass spectrometer consists of a laser desorption/ionization ion mobility mass spectrometer.

38. The laser desorption/ionization mass spectrometer of claim 27 wherein the focusing means comprises one of either a cylindrical lens or an ellipsoidal mirror.

39. The laser desorption/ionization mass spectrometer of claim 27 wherein the first focusing element comprises one of either a concave mirror, a plano convex lens, or a biconvex lens.

40. The laser desorption/ionization mass spectrometer of claim 32 wherein the second focusing element comprises one of either a cylindrical lens or an ellipsoidal mirror.

41. A laser desorption/ionization mass spectrometer comprising a laser optical bench, wherein the laser optical bench comprises:

a laser for producing light;

a first focusing element that receives light from the laser and focuses it predominantly in a single plane, wherein the plane is defined by a major axis and a minor axis;

a gradient neutral density filter (GNDF) wherein the first focusing means orients the light on the GNDF such that the major axis is aligned with the optical density gradient in a neutral density orientation;

a second focusing element for collecting and expanding light from the gradient neutral density filter;

beam steering means for directing light from the second focusing element to a target, the beam steering means including a dichroic element; and a third focusing element for focusing light from the beam steering means on the target thereby producing a target image;

wherein the ratio of the major axis to the minor axis of the target image is in a range of 5:1 and 20:1.

42. The laser desorption/ionization mass spectrometer of claim 44 wherein the dichroic element is a dichroic filter.

43. The laser desorption/ionization mass spectrometer of claim 41 wherein the dichroic element is a dichroic mirror.

44. The laser desorption/ionization mass spectrometer of claim 41 wherein the beam steering means further includes a mirror located between the first focusing element and the dichroic element.

45. The laser desorption/ionization mass spectrometer of claim 41 wherein the laser optical bench further comprises a trigger photodiode that receives light from the gradient neutral density filter.

46. The laser desorption/ionization mass spectrometer of claim 41 wherein the laser optical bench further comprises means for measuring an amount of applied laser energy in the light directed to the target.

47. The laser desorption/ionization mass spectrometer of claim 46 wherein the means for measuring an amount of applied laser energy in the light directed to the target comprises a fourth focusing element and a photodetector.

48. The laser optical bench of claim 46 wherein the means for measuring an amount of applied laser energy in the light directed to the target comprises a bandwidth filter and a photodetector.

49. The laser optical bench of claim 41 wherein the first focusing element comprises one of either a cylindrical lens or an ellipsoidal mirror.

50. The laser optical bench of claim 44 wherein the third focusing element comprises one of either a concave mirror, a plano convex lens, or a biconvex lens.

51. The laser optical bench of claim 41 wherein the second focusing element comprises one of either a cylindrical lens or an ellipsoidal mirror.

52. The laser desorption/ionization mass spectrometer of claim 46 wherein the first and second focusing elements comprise a cylindrical lens, and the third focusing element comprises a plano convex lens.

53. The laser desorption/ionization mass spectrometer of claim 52 wherein the laser optical bench further comprises means for measuring an amount of applied laser energy in the light directed to the target, the means for measuring an amount of applied laser energy in the light comprising a plano convex lens, a bandwidth filter, and a photodetector.

54. The laser optical bench of claim 1 wherein the target image diverges vertically along the major axis and is focused horizontally along the minor axis thereby diminishing the level of incident radiance on the GNDF below a damage threshold for the GNDF.

55. The laser optical bench of claim 14 wherein the target image diverges vertically along the major axis and is focused horizontally along the minor axis thereby diminishing the level of incident radiance on the GNDF below a damage threshold for the GNDF.

56. The laser desorption/ionization mass spectrometer of claim 27 wherein the target image diverges vertically along the major axis and is focused horizontally along the minor axis thereby diminishing the level of incident radiance on the GNDF below a damage threshold for the GNDF.

57. The laser desorption/ionization mass spectrometer of claim 41 wherein the target image diverges vertically along the major axis and is focused horizontally along the minor axis thereby diminishing the level of incident radiance on the GNDF below a damage threshold for the GNDF.

* * * * *